US008556190B2

(12) United States Patent
Tom et al.

(10) Patent No.: US 8,556,190 B2
(45) Date of Patent: Oct. 15, 2013

(54) APPARATUS FOR CREATING A WATER FORMED IMAGE

(75) Inventors: Danny Tom, Markham (CA); Douglas Adams, Markham (CA)

(73) Assignee: Pyrotek Special Effects Inc., Ontario (CA)

( * ) Notice: Subject to any disclaimer, the term of this patent is extended or adjusted under 35 U.S.C. 154(b) by 209 days.

(21) Appl. No.: 12/531,174

(22) PCT Filed: Mar. 12, 2008

(86) PCT No.: PCT/CA2008/000467

§ 371 (c)(1),
(2), (4) Date: Jan. 6, 2010

(87) PCT Pub. No.: WO2008/110000

PCT Pub. Date: Sep. 18, 2008

(65) Prior Publication Data

US 2010/0139134 A1 Jun. 10, 2010

(30) Foreign Application Priority Data

Mar. 12, 2007 (CA) ..... 2581459

(51) Int. Cl.

| | |
|---|---|
| ***B05B 17/04*** | (2006.01) |
| ***B05B 17/08*** | (2006.01) |
| ***B05B 1/00*** | (2006.01) |
| ***F21S 8/00*** | (2006.01) |

(52) U.S. Cl.
USPC ..... 239/12; 239/17; 239/18; 239/20; 239/22; 239/23; 239/211

(58) Field of Classification Search
USPC ..... 239/16, 17, 18, 20, 22, 23, 211, 275, 239/279, 280, 285, 590.5, 601; 40/407
See application file for complete search history.

(56) References Cited

U.S. PATENT DOCUMENTS

| | | | | |
|---|---|---|---|---|
| 3,560,641 | A | | 2/1971 | Taylor et al. |
| 3,635,402 | A | * | 1/1972 | Kawamura et al. ..... 239/18 |
| 3,640,463 | A | * | 2/1972 | Kawamura et al. ..... 239/17 |
| 4,294,406 | A | * | 10/1981 | Pevnick ..... 239/20 |
| 4,974,779 | A | | 12/1990 | Araki et al. |
| 5,067,653 | A | | 11/1991 | Araki et al. |
| 5,265,802 | A | | 11/1993 | Hobbs et al. |
| 5,340,024 | A | * | 8/1994 | Fuller et al. ..... 239/17 |
| 5,368,228 | A | | 11/1994 | Adamson et al. |
| 5,445,322 | A | | 8/1995 | Formhals et al. |
| 6,127,658 | A | * | 10/2000 | Kohav ..... 219/390 |

(Continued)

FOREIGN PATENT DOCUMENTS

| | | |
|---|---|---|
| CA | 2285728 | 4/2000 |
| EP | 814369 B1 | 8/2003 |

*Primary Examiner* — Ryan Reis
(74) *Attorney, Agent, or Firm* — Jansson Munger McKinley & Shape Ltd.

(57) ABSTRACT

An apparatus for pixelating falling water droplets to create a graphical image comprising one or more elevated water display heads having a plurality of spaced apart nozzles in one or more rows, each of said nozzles has a water inlet and a water outlet. A high speed solenoid is provided for each nozzle for opening and closing of the water outlet for each nozzle to control the speed at which water exits the nozzles. A water reservoir is provided above the water inlets for the solenoids and nozzles so that water pressure to the nozzles is maintained by gravity.

16 Claims, 8 Drawing Sheets

(56) References Cited

U.S. PATENT DOCUMENTS

| | | | | |
|---|---|---|---|---|
| 6,533,190 | B1 | 3/2003 | Wang | |
| 6,557,777 | B1 * | 5/2003 | Pevnick | 239/20 |
| 6,644,768 | B2 | 11/2003 | Vega et al. | |
| 6,702,687 | B1 | 3/2004 | Henry | |
| 7,072,110 | B2 | 7/2006 | Palovuori | |
| 2007/0125871 | A1 * | 6/2007 | Wysocki | 239/12 |

* cited by examiner

APPARATUS FOR CREATING A WATER FORMED IMAGE

FIELD OF THE INVENTION

This invention relates to an apparatus for pixelating water droplets. In particular, this invention relates to an apparatus for pixelating falling water droplets to create a graphical image.

BACKGROUND AND DESCRIPTION OF THE PRIOR ART

It is known to create water screens using a falling sheet of water or closely spaced falling water droplets on to which images are projected. Difficulties have been encountered providing water droplets that hold their shape as they fall. Consequently, high resolution images on projection water screens are not obtainable as the water droplets do not enable the projection of precise images.

In the entertainment industry, where images are required to be of a sufficient size and resolution for an audience to appreciate the image formed, there is a need for a apparatus that allows for higher installation heights and sharper consistent image quality, as well as a screen that allows viewers to differentiate between the pixilation of droplets to create an image with a high resolution that can be in varying dimensions.

SUMMARY OF THE INVENTION

It is an object of the present invention to provide a solution to the problem of water droplets losing their optimal shape while being dispensed from nozzles at varying heights.

In one aspect, the present invention provides an apparatus for pixelating falling water droplets to create a graphical image. The apparatus comprises a water management system for providing, controlling and maintaining a closed-loop pressurized water supply, an elevated water display head having a plurality of spaced apart nozzles in one or more rows and a high speed solenoid for each nozzle and a control means for controlling the water supply and for controlling the formation of the falling water droplets through each solenoid and nozzle. The water droplets falling from the plurality of nozzles form a graphical image that retains its shape as it falls.

In another aspect, the present invention relates to an apparatus capable of producing pixelated falling water droplets to create a graphical image or a falling sheet of water onto which an image may be projected.

In a further aspect, the present invention provides nozzles for forming falling water droplets that retain their shape as they fall. The nozzles have an inlet and a small outlet orifice and a hourglass shaped passageway in cross-section from inlet to outlet orifice. In a preferred embodiment, the hourglass shaped passageway is coated to provide superior flow dynamics.

BRIEF DESCRIPTION OF DRAWINGS

In drawings which illustrate by way of example only one embodiment of the invention.

Figure 1:
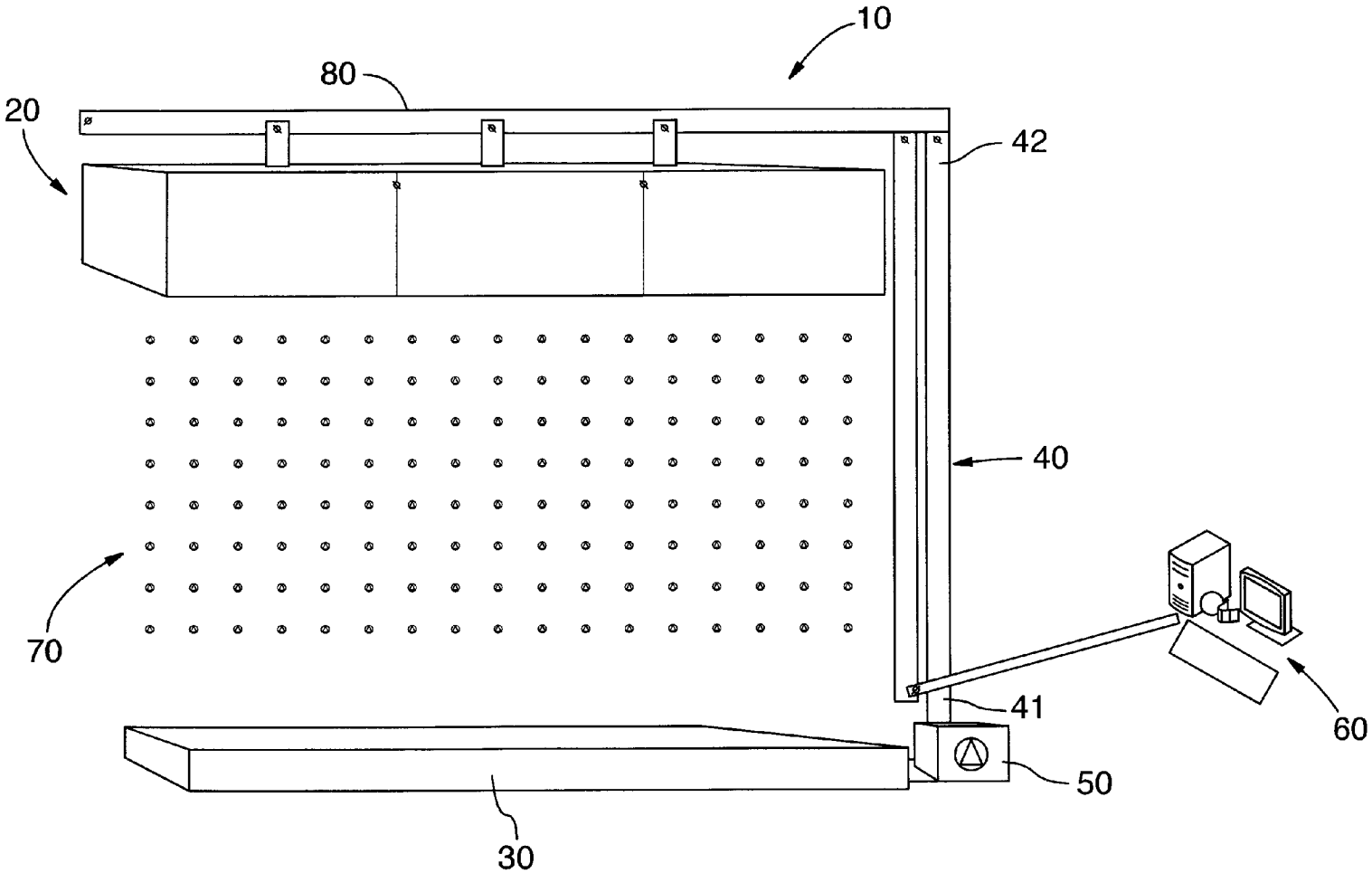
FIG. 1 is a schematic diagram of one embodiment of the apparatus for pixelating falling water droplets to create a graphical image according to the present invention having a water management system and a plurality of elevated water display heads.
Figure 2:
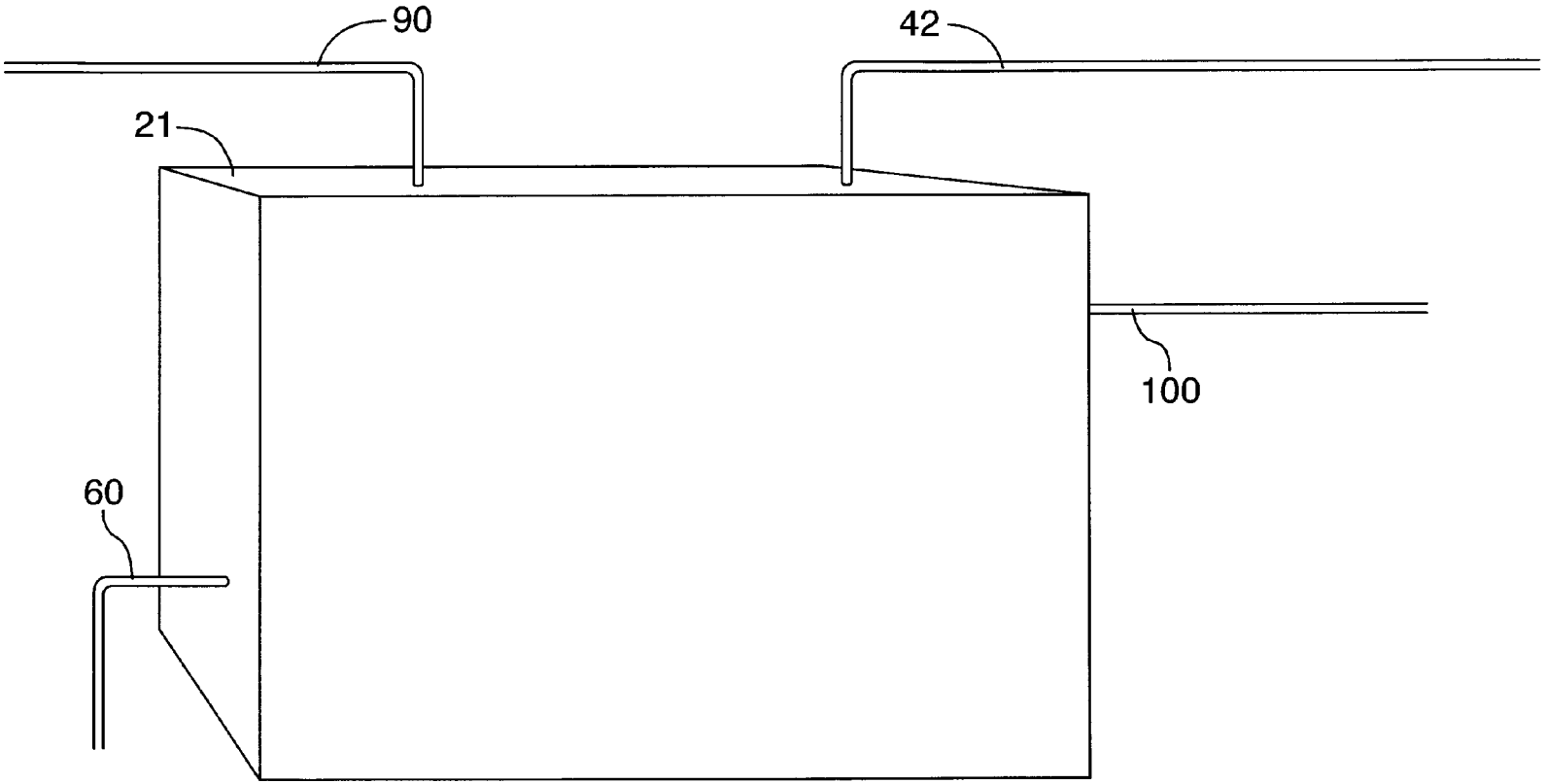
FIG. 2 is a schematic illustration of the elevated water display head of FIG. 1 shown with the inlet into the water reservoir.
Figure 3:
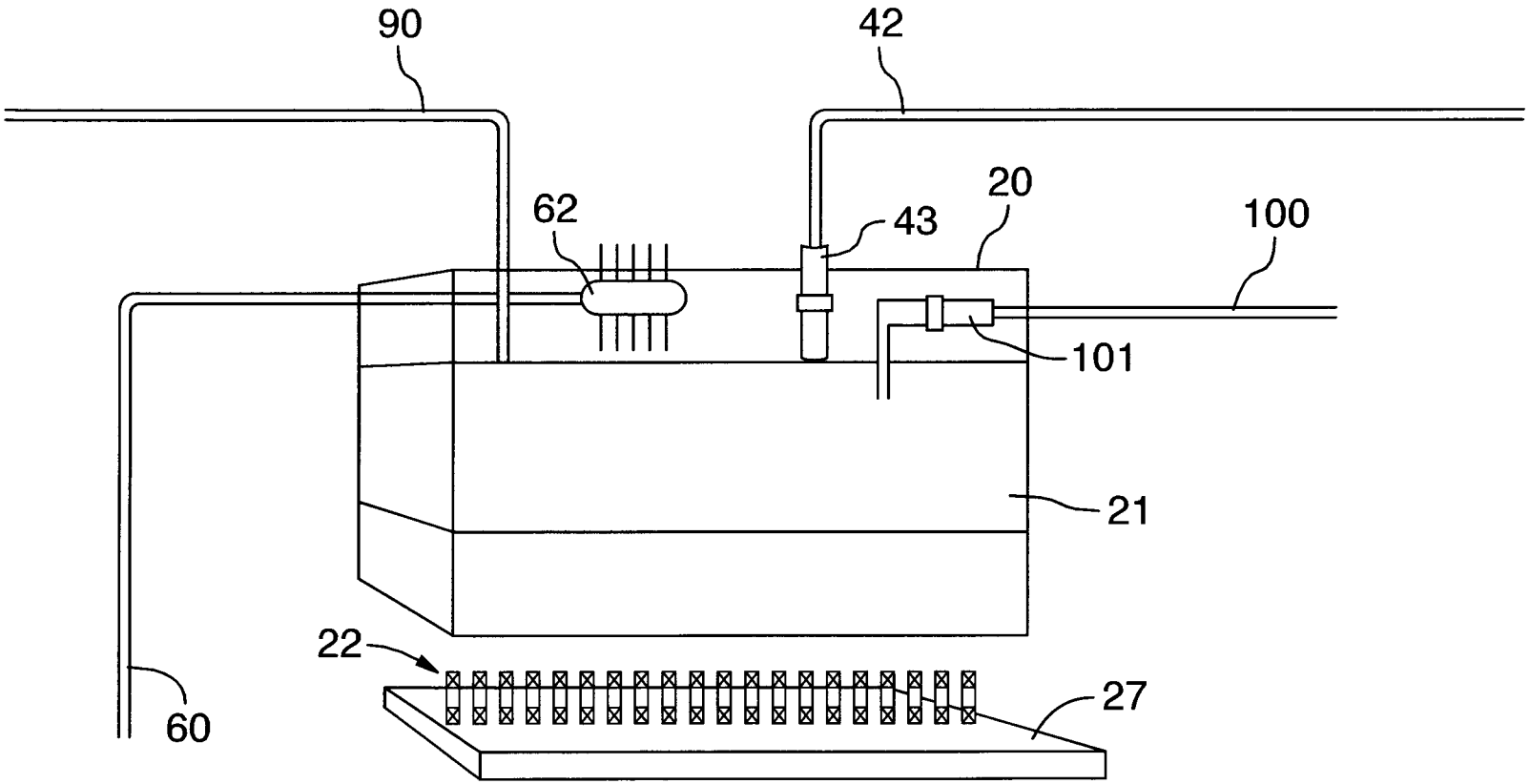
FIG. 3 is a schematic diagram of one embodiment of the elevated water display head of FIG. 1.
Figure 4:
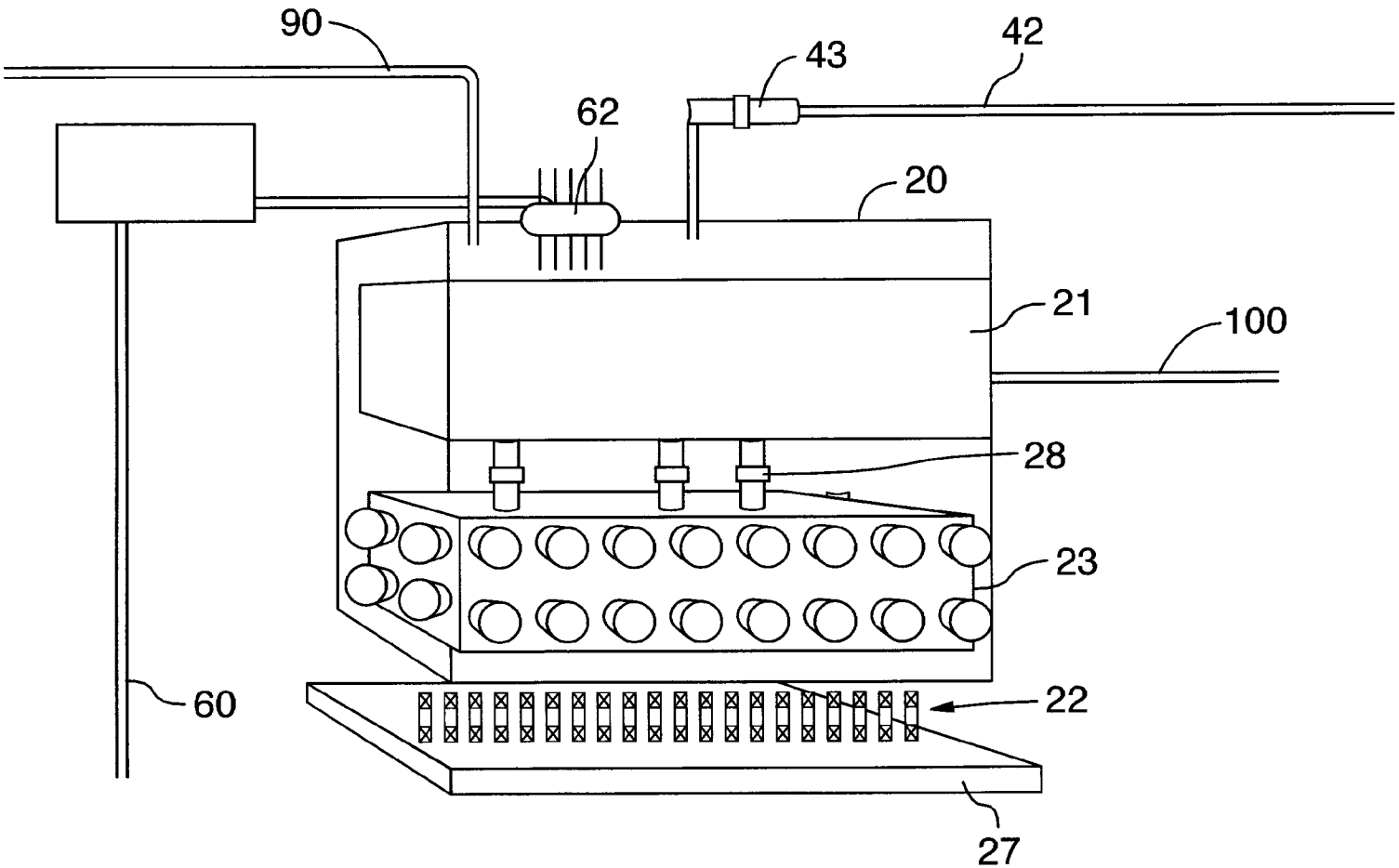
FIG. 4 is a schematic diagram of one embodiment of the elevated water display head of FIG. 1 shown with the solenoids.

Similar references are used in different figures to denote similar components.

DETAILED DESCRIPTION

In an embodiment of the present invention, indicated generally at 10, the various components of the apparatus are shown, namely the elevated water display head shown generally at 20, the water reservoir 21, the plurality of spaced apart nozzles 22, the row of high speed solenoids for each nozzle shown generally at 23, the water basin 30, the water conduit 40, the pump means 50, and the control means shown generally at 60.

The present invention provides an apparatus for creating a water droplet pixelated image shown generally at 70 comprising a elevated water display head 20 having a water reservoir 21, a plurality of spaced apart nozzles 22 set upon a nozzle plate 27 adapted to dispense water from said water reservoir 21 between an on position to an off position.

In the elevated water display head 20, there is also a row of solenoids 23 to control the nozzles 22 between an on position and an off position, as shown more generally in FIG. 5, as described below.

The apparatus also has a water basin 30 that is adapted to receive water droplets dispensed from the nozzles 22, as well as a water conduit 40 which has a receiving end 41 and a water inlet 42. The receiving end 41 is attached to the water basin 30 to receive water, and the water inlet 42 has a valve 43 is attached to the water reservoir 21 within the elevated water display head 20. Through the action of the pump means 50, the water can circulate from the water basin 30 into the receiving end 41 of the water conduit 40, up towards the disposing end 42 of the water conduit 40, and out into the water reservoir 21. There are elevated water display head valves 28 present between the water reservoir 21 and the solenoids 23 to control the flow of water on or off towards the nozzles 22. Sufficient horsepower must be present in the pump means 50 so as to recirculate water within the apparatus to maintain adequate flow dynamics. The storage of water must enable a constant supply of water across the solenoids 23 in the elevated water display head 20. There is a 3:1 ratio water between the water basin 30 and the water reservoir 21 in the elevated water display head 20. About 3 gallons of water or 4 to 6 inches of column pressure should be present in the water reservoir 21 to ensure that there is a consistent water image formed when the water is dropped from the nozzles 22.

The apparatus 10 enables water to be circulated within the water conduit 40 from the receiving end 41 to the water inlet 42. There is a control means 60 to control the solenoids 23, which sends signals to a sensor 62, so that water dropped from the plurality of spaced apart nozzles 22 in the on position forms a pixelated image 70 of water droplets before reaching the water basin 30.

The size of the water basin 30 will depend on the splashing distance of water at the base of the apparatus.

Figure 5:
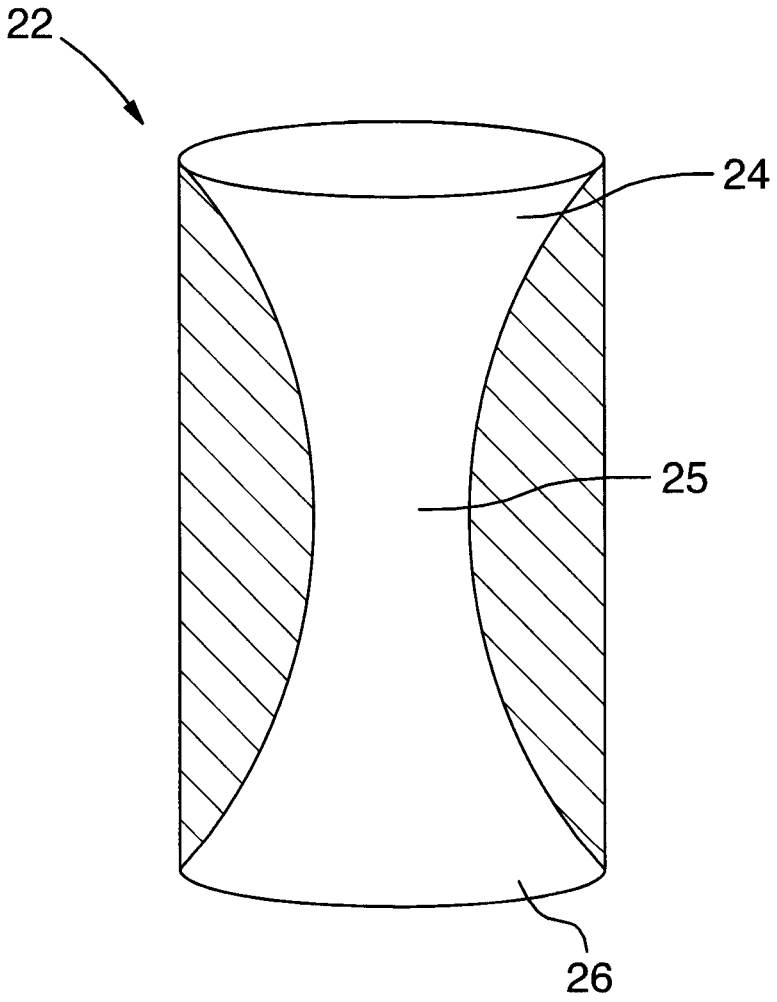
FIG. 5 is a partial perspective view of a nozzle used in the elevated water display head of FIG. 1 shown with the hourglass shaped passageway.

As shown in FIG. 5, each nozzle 22 has an inlet orifice 24, a hourglass shaped passageway 25 and a outlet orifice 26, where the hourglass shaped passageway 25 has a narrower diameter in the mid section as compared to the inlet 24 and outlet orifices 26. When dispensing water through the nozzles, the droplets should be shaped as a tear drop for the greatest period of time in order to provide a consistent pixelated image across the water screen. By shaping the passageway 25 as an hourglass, the water droplets dispensed from the outlet orifice 26 can retain an hourglass shape for as long as possible, including lengths of 10 feet or more, and even to heights of 30 feet. Also, by shaping the passageway 25 as an hourglass, a columnated effect of the water dispensing that is important in forming the water screen is retained for as long as possible as it manually prevents the clumping of water that results from hydrophilic forces that attract water molecules together. Waxes, such as Teflon® and Caranuba wax, can be used on the inner and outer surfaces of the passageway 25 to further prevent the hydrophilic forces of the water. Nozzles 22 that are used in precise medical instrumentation may be used in conjunction with high speed solenoids 23 to produce a high resolution pixelated image on the water screen 70.

The nozzles 22 are individually controlled and are high speed. The nozzles 22 are spaced apart from one another, such as being spaced 0.4 inches apart. A control means 70, such as a computer, controls the operation of the row of solenoids 23 which in turn control the opening and closing of the nozzles 22 in a rapid fashion, thereby producing scrolling water-formed images on the water screen 70 when water is dispensed from the nozzles 22. The nozzles 22 can be opened and closed by the solenoids 23 as fast as 200 times per second. This modulation of dispensing water droplets forms a continuous matrix of horizontal water dots that is analogous to the operation of a dot matrix printer.

The path length from each solenoid to the nozzle is the same and the timing is controlled to accommodate different path lengths.

Figure 8:
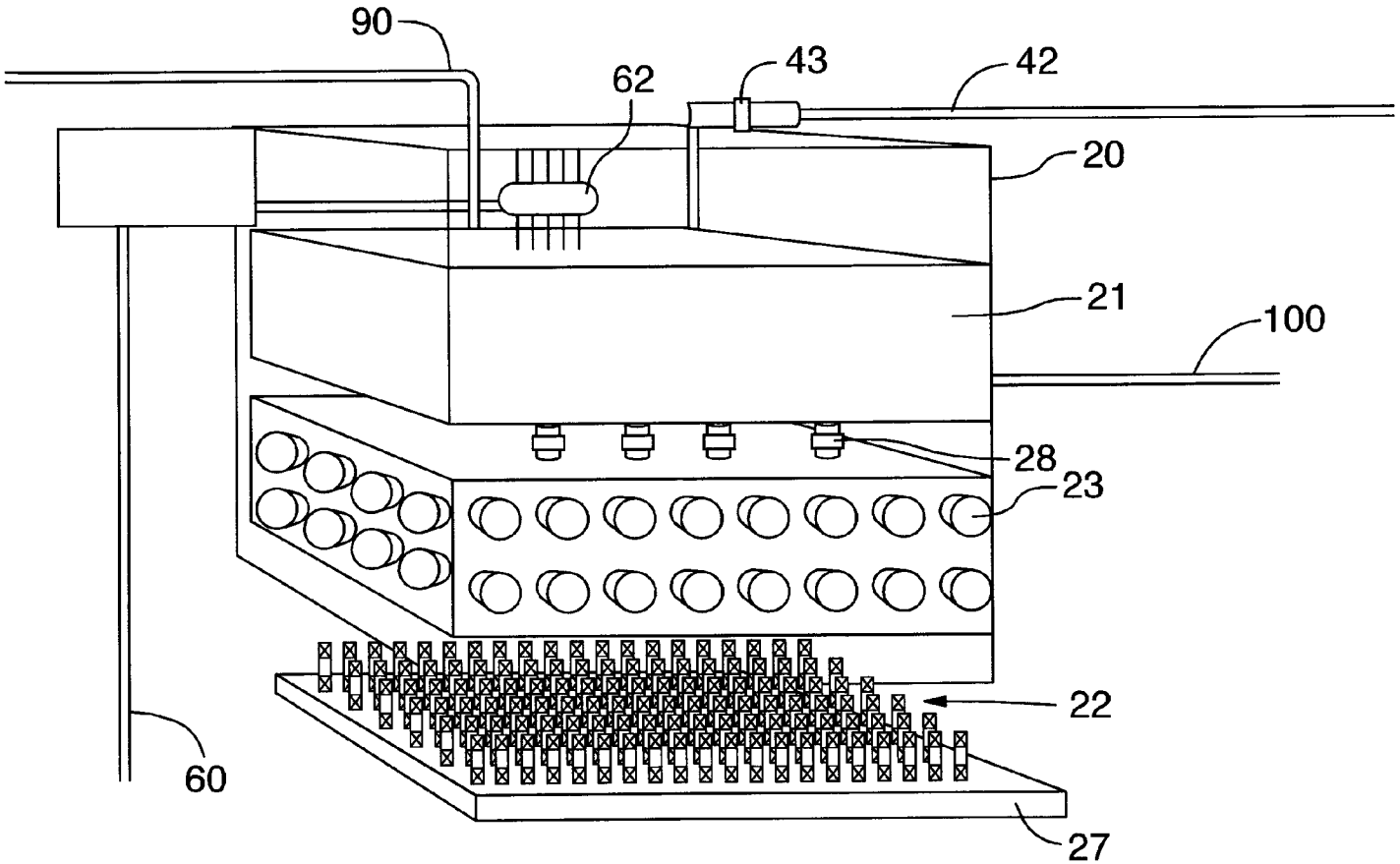
FIG. 8 is a schematic diagram of one embodiment of the elevated water display head of FIG. 1 shown creating a three-dimensional image.

As seen in FIG. 8, the high speed solenoids 23 can be oriented in different rows so as to allow for the formation of three-dimensional images. Although the rows of solenoids 23 can be offset, the elevated water display head can be placed in modules, such as two foot modules, which can be interconnected side to side to form lengths up to forty eight feet, and including lengths of twelve, twenty four, and thirty six feet. In certain embodiments, there is a clearance of 12 feet on both sides of the graphical water screen. In some embodiments, the elevated water display head 20 is designed to be suspended off a trussing system 80. Hardware may be included with the present invention for hanging water screen structure off any pipe, such as a two inch diameter pipe.

Figure 6:
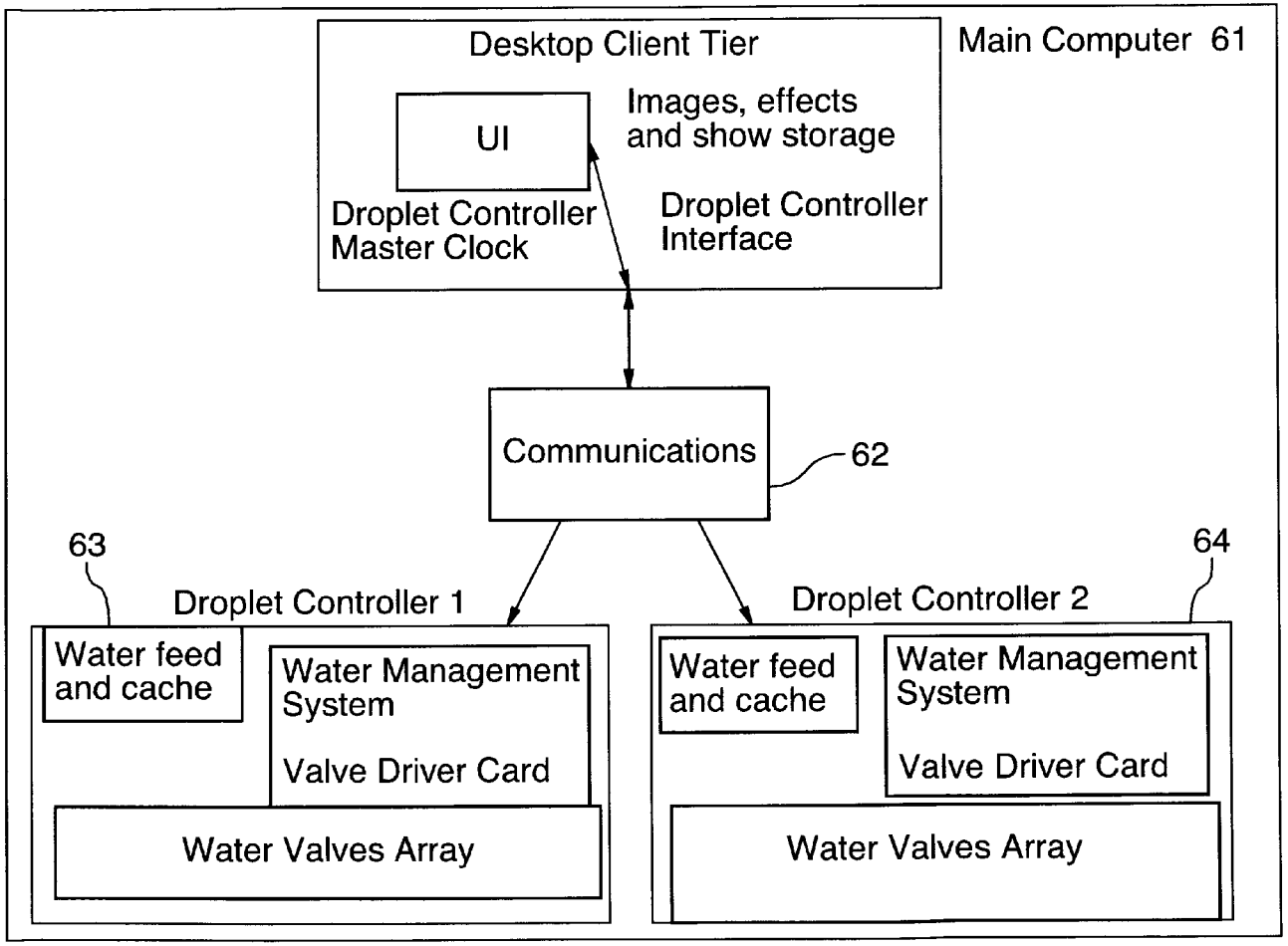
FIG. 6 is a flow chart of the control means of FIG. 1 shown with the communications to the droplet controllers.

In FIG. 6, a flowchart of the operation of the of the apparatus 10 via the control means 60 is shown, namely the main computer 61, the communication means 62, droplet controller 63 and second droplet controller 64.

The control means 60 provides an automated mechanism for translating common graphics files into water displayable droplet images. The control means 60 has a mechanism to allow users, particularly those in the events and/or lighting field, to trigger water graphical effects or program complete water graphical shows through a computer or console applications thereby allowing for wider scale adaptation of the graphical water screen system.

Using the present invention, graphical file images can be translated to a form that is displayable on the water screen 70. A special algorithm which takes common images, including .jpg, .gif, .bmp and .png files, may be used in conjunction with the control means 60. For example, a special algorithm may take multi-coloured graphics files with various pixel formats and translate them to homogeneous pixel-formatted monochrome file formats displayable as water graphical images through the control means 60.

Similar to broadcasting technology, there is a requirement to synchronize the pixilated water images to other equipment like video cameras, lighting equipment and other application software. In certain embodiments, such as some commercial applications, the repeatability factor is important and a special apparatus is required to synchronize pressurized water graphical images with a time source. As part of an algorithm, the height of fall of water and the terminal velocity of water may be two aspects that are taken into account and processed through the control means 60.

In one embodiment of the present invention having a water free fall rate of 1 second for a 30 foot drop and a response time of 5 milliseconds for electronic solenoid values, one can expect 200 cycles from each value per second and would provide a vertical resolution of about 200 pixels.

The resolution of the water screen 70 is dependent on the width of the water screen. A 12 ft water screen would, in theory, provide a horizontal resolution of 360 pixels.

As with video graphics technology, the wider or larger the display surface, the more intense the processor power requirements will be needed to maintain visual integrity and functionality. For larger graphical water screens, the challenges are similar. The present invention provides a parallel processing and parallel control technique applied to the specific technology requirements of a graphical water screen.

Parallel processing and solenoid control are present either separately or individually to provide extra-wide, even and consistent water displays. Multiple central processing units (CPUs) running over an Ethernet from serial to parallel to serial may be used for each row of solenoids 23.

Various effects are possible through the use of the present invention. Practically any image, including those that can be scanned using a flat bed scanner, can be converted for display using the water screen. In certain embodiments, the main computer 61 will convert the color information into a monochrome image. Images can be queued for back to back display.

Text messages are possible with a variety of fonts. The width of the messages may depend on font sizes and required legibility.

Through the control means 60, various water effects may also be possible, including tornado, barber effects and slotted cylinders.

The present invention may be controlled by software, including Windows XP Operating System and the Control program is a user-friendly graphical interface. The user can use the software to design, create and save complete synchronized shows on the system. The present invention is capable of interfacing various codes, including to SMPTE or MIDI time codes, and can also interface to lighting consoles, including DMX-compatible lighting consoles, which allows users to allow lighting designers use the apparatus 10.

Figure 7:
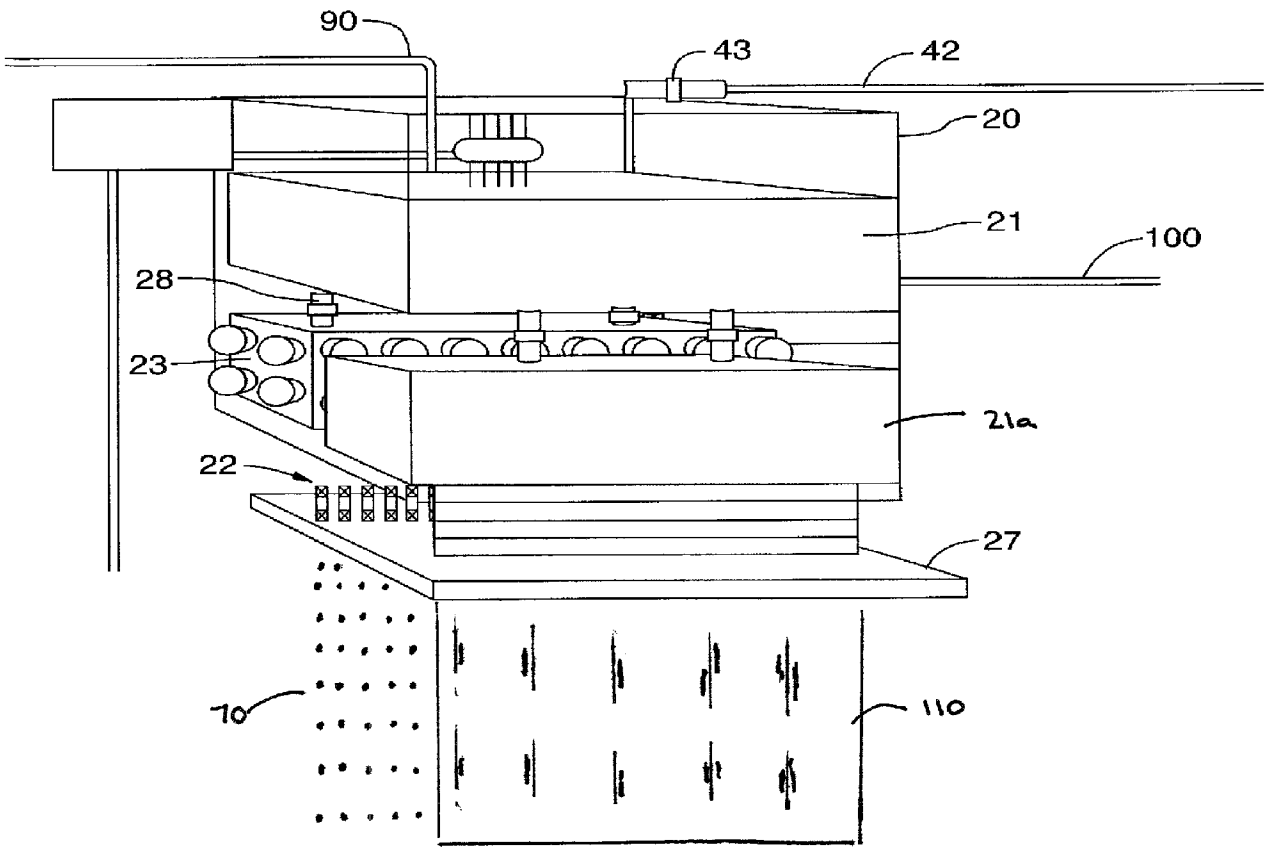
FIG. 7 is a schematic diagram of one embodiment of the elevated water display head of FIG. 1 shown from the rear and with the falling sheet of water.

This invention further provides a dual-head system, as shown in FIG. 7 from the rear, having a falling sheet of water 110 at the rear and a graphical water screen 70 in the front which can allow users to either superimpose images or have the flexibility of applying one form of projection screen or another in a given show. The falling sheet of water 110 is sourced by a constant flow to the second water reservoir 21*a* in parallel to the water reservoir 21.

Closed-loop and open loop water systems may be used with the present invention. In certain embodiments, a water supply of 90 gallons is required to fill the closed loop water re-circulation system and about 5 gallons of distilled water per day needs to be injected into the system to account for evaporation.

Certain embodiments of the present system may use a water feed system that controls and maintain a closed-loop pressurized water circulation system across the apparatus 10 that is coupled to an open system (using main city water or similar). By coupling the apparatus to a water feed system, near-instantaneous corrections of the "desired" conditions of the closed-loop water system can be made.

As shown in FIG. 5, an outlet 100 with an overflow valve 101 may also be attached to the water reservoir 21 as a safety feature.

A power source is needed to operate the apparatus. For instance, certain embodiments of the present invention can be powered using a single phase 120-205 VAC power source with the apparatus requiring 2400 Watts of power.

A safety feature of the present invention is the use a vacuum source with the apparatus 10 to apply a negative pressure to prevent water from dripping from nozzles 22 wherein the operating solenoid 23 is intended to be closed. When the system is not in use and the solenoids 23 are directing the nozzles 22 not to dispense water, the anti-drip negative pressure vacuum system, as shown in the vacuum line 90 in FIG. 7 is connected to the elevated water display head 21. The vacuum line 90 can be activated to prevent water from being inadvertently released from the nozzles 22.

The present invention has an operating temperature range of about +10 to +50 degrees Celsius.

The present invention also comprises a method for pixelating falling water droplets to create a graphical image. The water management system provides, controls and maintains a closed-loop pressurized water supply, the elevated water display head 20 has a plurality of spaced apart nozzles 22 in one or more rows and a high speed solenoid 23 for each nozzle 22 and a control means 60 for controlling the water supply and for controlling the formation of the falling water droplets through each solenoid 23 and nozzle 22. The control means 60 controls the formation of water droplets falling from each of said plurality of nozzles to form a graphical image that retains its shape as it falls.

Numerous modifications, variations, and adaptations may be made to the particular embodiments of the invention described above without departing from the scope of the invention, which is defined in the claims.

The embodiments of the invention in which an exclusive property or privilege is claimed are defined as follows:

1. An apparatus for pixelating falling water droplets to create a graphical image comprising a water management system for providing, controlling and maintaining a closed-loop pressurized water supply, one or more elevated water display heads having a plurality of spaced apart nozzles arranged on a replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to the water outlets of said nozzles to control the speed at which water exits the nozzles and whereby water droplets falling from said plurality of nozzles form a graphical image that retains its shape as it falls and wherein a vacuum line is connected to the water reservoir to prevent water leaking through the solenoids and nozzles when the water reservoir is placed under negative pressure.

2. The apparatus according to claim 1 wherein each of said plurality of nozzles has an inlet an hourglass shaped passageway in cross-section from inlet to outlet orifice.

3. The apparatus according to claim 2 wherein the hourglass shaped passageway is coated to provide superior flow dynamics.

4. The apparatus according to claim 3 wherein the hourglass shaped passageway is coated with Carnauba or Teflon.

5. An apparatus for pixelating falling water droplets to create a graphical image comprising a water management system for providing, controlling and maintaining a closed-loop pressurized water supply, one or more elevated water display heads having a plurality of spaced apart nozzles arranged on a replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to the water outlets of said nozzles to control the speed at which water exits the nozzles and whereby water droplets falling from said plurality of nozzles form a graphical image that retains its shape as it falls wherein the water display head has sensors connected to said control means to monitor and maintain the water level in said water reservoir and said water display head contains a second water reservoir in parallel to said solenoids and plurality of nozzles for producing a falling sheet of water and the water management system and control means provides a constant flow of water to said second water reservoir.

6. The apparatus according to claim 5 wherein the water management system comprises a catch basin for collecting the falling water droplets after falling, a water conduit between said catch basin and the inlet to the water reservoir on said elevated water display head and pump means to circulate the water from the catch basin to the water reservoir through the water conduit.

7. The apparatus according to claim 1 wherein a plurality of elevated water display heads are provided to form a wide graphical image, wherein each water display head produces a portion of the wide graphical image and the control means maintains equal water pressure and synchronizes the operation of the solenoids in each water display head to maintain the visual integrity of the wide graphical image.

8. The apparatus according to claim 1 wherein the water management system/control means and water display head are capable of producing pixelated falling water droplets to create a graphical image or a falling sheet of water onto which an image may be projected.

9. The apparatus according to claim 2 wherein said nozzles are spaced 0.4 inches apart.

10. The apparatus according to claim 9 wherein the control means is capable of opening and closing the solenoids and nozzles up to 200 times per second.

11. The apparatus according to claim 1 wherein the water display head has a plurality of rows of spaced apart nozzles and a high speed solenoid for each nozzle whereby the water droplets falling from said plurality of rows of spaced apart nozzles form a three dimensional graphical image.

12. The apparatus according to claim 11 wherein the path length from each solenoid to the nozzle is the same.

13. The apparatus according to claim 11 wherein the timing is controlled to accommodate different path lengths from each solenoid to the nozzle.

14. The apparatus according to claim 1 wherein the water droplets fall from heights of 10 feet or more.

15. A method for pixelating falling water droplets to create a graphical image comprising providing a water management system for providing, controlling and maintaining a closed-loop pressurized water supply, an elevated water display head having a plurality of spaced apart nozzles arranged on a replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to the water outlets of said nozzles to control the speed at which water exits the nozzles and whereby the control means controls the formation of water droplets falling from each of said plurality of nozzles to form a graphical image that retains its shape as it falls wherein the water reservoir is placed under negative pressure to prevent water leaking through the solenoids and nozzles when the water outlet is closed.

16. The method for pixelating falling water droplets to create a graphical image according to claim 15 wherein said water display head contains a second water reservoir in parallel to said solenoids and plurality of nozzles for producing a falling sheet of water and the water management system and control means provides a constant flow of water to said second water reservoir.

* * * * *